US010071490B2

(12) United States Patent
Shimizu et al.

(10) Patent No.: US 10,071,490 B2
(45) Date of Patent: Sep. 11, 2018

(54) ELECTRIC SHAVER

(71) Applicant: Panasonic Intellectual Property Management Co., Ltd., Osaka (JP)

(72) Inventors: Hiroaki Shimizu, Shiga (JP); Yasuhide Matsuoka, Shiga (JP); Toshio Ikuta, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 54 days.

(21) Appl. No.: 14/939,746

(22) Filed: Nov. 12, 2015

(65) Prior Publication Data

US 2016/0151922 A1 Jun. 2, 2016

(30) Foreign Application Priority Data

Nov. 28, 2014 (JP) ..... 2014-241805

(51) Int. Cl.
*B26B 19/04* (2006.01)
*B26B 19/28* (2006.01)
*B26B 19/14* (2006.01)

(52) U.S. Cl.
CPC ..... *B26B 19/048* (2013.01); *B26B 19/146* (2013.01); *B26B 19/282* (2013.01)

(58) Field of Classification Search
CPC .... B26B 19/048; B26B 19/146; B26B 19/282
See application file for complete search history.

(56) References Cited

U.S. PATENT DOCUMENTS 5,539,984 A * 7/1996 Ikuta ..... B26B 19/046 30/346.51
6,892,457 B2 * 5/2005 Shiba ..... B26B 19/048 30/43.92
7,020,966 B2 * 4/2006 Shiba ..... B26B 19/046 30/346.51

(Continued)

FOREIGN PATENT DOCUMENTS

CN 100376366 C 3/2008
CN 101791805 A 8/2010

(Continued)

OTHER PUBLICATIONS

The Extended European Search Report dated Apr. 22, 2016 for the related European Patent Application No. 15193815.6.

(Continued)

*Primary Examiner* — Hwei C Payer
(74) *Attorney, Agent, or Firm* — McDermott Will & Emery LLP

(57) ABSTRACT

Electric shaver includes body, head having blade block, and head supporting part connecting body with head. Head supporting part includes swing supporting part supporting head swingably about two swing axes, and head float part so that head is movable up and down with respect to body. This configuration allows head to swing about the two axes, and thus head easily follows undulations of skin. Head is movable up and down with respect to body, and thus head sinks with respect to body when head is strongly pressed against the skin. The aspect provides electric shaver that has a high follow-up performance of head swinging according to undulations of skin and hardly irritates the skin strongly.

10 Claims, 7 Drawing Sheets

(56) References Cited

U.S. PATENT DOCUMENTS

| | | | | |
|---|---|---|---|---|
| 7,841,090 | B2 * | 11/2010 | Eichhorn | B26B 19/048 30/346.51 |
| 8,011,102 | B2 * | 9/2011 | Sato | B26B 19/046 30/346.51 |
| 8,181,349 | B2 * | 5/2012 | Sagawa | B26B 19/048 30/43.7 |
| 8,347,508 | B2 * | 1/2013 | Shimizu | B26B 19/28 30/45 |
| 8,458,911 | B2 * | 6/2013 | Shimizu | B26B 19/048 30/45 |
| 9,527,219 | B2 * | 12/2016 | Iwasaki | B26B 19/048 |
| 2004/0163257 | A1 | 8/2004 | Morisugi et al. | |
| 2004/0231160 | A1 | 11/2004 | Shiba et al. | |
| 2004/0237310 | A1 * | 12/2004 | Shiba | B26B 19/048 30/43.92 |
| 2007/0227007 | A1 * | 10/2007 | Fukutani | B26B 19/10 30/43.1 |
| 2008/0034591 | A1 | 2/2008 | Fung | |
| 2008/0256799 | A1 * | 10/2008 | Shiba | B26B 19/046 30/43.92 |
| 2009/0241343 | A1 * | 10/2009 | Yamasaki | B26B 19/048 30/43.92 |
| 2010/0175263 | A1 | 7/2010 | Shimizu et al. | |
| 2010/0175264 | A1 | 7/2010 | Shimizu et al. | |
| 2010/0180448 | A1 * | 7/2010 | Sato | B26B 19/048 30/43.92 |
| 2011/0094107 | A1 * | 4/2011 | Ring | B26B 19/048 30/43.1 |
| 2012/0216409 | A1 * | 8/2012 | Shigeta | B26B 19/288 30/43.91 |
| 2014/0165406 | A1 | 6/2014 | Shimizu et al. | |
| 2016/0151922 | A1 * | 6/2016 | Shimizu | B26B 19/282 30/43 |

FOREIGN PATENT DOCUMENTS

| | | | |
|---|---|---|---|
| EP | 1439040 | A1 | 7/2004 |
| JP | 2003-093765 | A | 4/2003 |
| JP | 2003-210871 | A | 7/2003 |
| JP | 2010-162135 | A | 7/2010 |

OTHER PUBLICATIONS

English Translation of Chinese Search Report dated May 28, 2018 for the related Chinese Patent Application No. 201510850115.4.

* cited by examiner

ELECTRIC SHAVER

RELATED APPLICATIONS

This application claims the benefit of Japanese Application No. 2014-241805, filed on Nov. 28, 2014, the disclosure of which Application is incorporated by reference herein.

TECHNICAL FIELD

The disclosure relates to an electric shaver.

BACKGROUND ART

An existing electric shaver includes a body having a grip, a head, and a head supporting part. The head has multiple blade blocks. A blade block is a set of an outer blade and an inner blade. The head supporting part supports the head swinging with respect to the body according to undulations of skin.

Japanese Patent Unexamined Publication No. 2010-162135 discloses an existing electric shaver as such an example. With an existing electric shaver, the head includes an outer blade and an inner blade each having a longitudinal direction. The head supporting part has first and second swing axes pivoting the head. The first swing axis extends in the longitudinal direction of the blade blocks; the second swing axis extends in the transverse direction of the blade blocks.

When the electric shaver is moved along the skin surface while being pressed against the skin, the head swings about at least one of the first and second swing axes according to undulations of the skin. According to the above-described related art, the head can be moved while the head angle with respect to the body changing according to undulations of the skin.

SUMMARY OF THE INVENTION

With the above-described electric shaver, when the head is strongly pressed against skin, a force exerted from the head on the skin may be absorbed insufficiently due to the head swinging. In such a case, the skin may enter the inside of the outer blade to strongly irritate the skin.

An object of the disclosure is to provide an electric shaver that has high follow-up performance of head swinging with undulations of skin and hardly irritates the skin strongly.

An electric shaver according to one aspect of the disclosure includes a body having a grip, a head having a blade block that is a set of outer and inner blades, and a head supporting part connecting the body with the head. The head supporting part includes a swing supporting part and a head float part. The swing supporting part supports the head swingably about two swing axes. The head float part supports the head so that the head is vertically movable with respect to the body.

An electric shaver according to the above-described aspect has high follow-up performance of head swinging with undulations of skin and hardly irritates the skin strongly.

Figure 1:
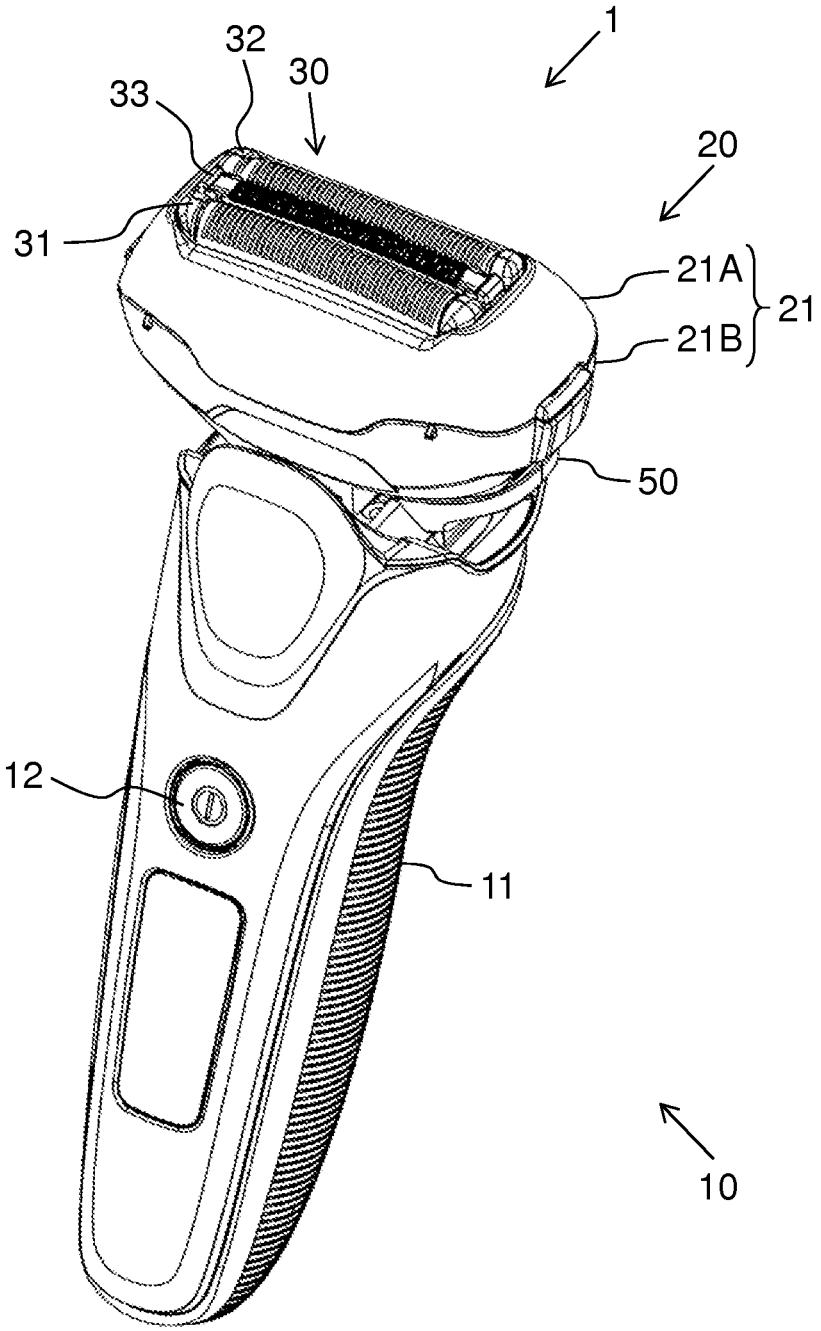
FIG. 1 is a perspective view of an electric shaver according to an exemplary embodiment.

DESCRIPTION OF EMBODIMENT (An Example of a Possible Form of an Electric Shaver)

[1] An electric shaver according to one aspect of the disclosure includes a body having a grip, a head having a blade block that is a set of outer and inner blades, and a head supporting part connecting the body with the head. The head supporting part includes a swing supporting part and a head float part. The swing supporting part supports the head swingably about two swing axes. The head float part supports the head so that the head vertically movable with respect to the body.

According to the aspect, the head is swingable about two swing axes, and thus the head angle with respect to the body easily changes according to undulations of skin. The head can move up and down with respect to the body, and thus when the head is strongly pressed against skin, the head moves down with respect to the body to reduce a force exerted on the skin. Consequently, the skin hardly enters the inside of the outer blade and hardly irritates the skin strongly.

[2] With the electric shaver according to one aspect of the disclosure, at least one of the two swing axes is disposed closer to the blade block than the head float part.

A shorter distance between the outer blade (a part where the head contacts skin) and the swing axis of the head swinging provides a smaller amount of head movement while the head is swinging following undulations of the skin. This enhances the operability of the electric shaver. With this aspect, the distance between the contact part of the head and at least one swing axis is shorter than the case where the head float part is provided closer to the blade block than from the two swing axis. This enhances the operability of the electric shaver.

[3] With an electric shaver according to one aspect of the disclosure, the two swing axes are disposed closer to the blade block than the head float part.

With this aspect, the distance between the contact part of the head and the two swing axes is shorter than the case where the head float part is provided closer to the blade block than from at least one of the two swing axes. This further enhances the operability of the electric shaver.

[4] With the electric shaver according to one aspect of the disclosure, the head includes multiple blade blocks, a head case supporting the outer blade, and a blade float part that supports the multiple blade blocks so that the blade blocks are vertically movable with respect to the head case. The force of the head float part exerted on the head to lift the head off the body is greater than a force of the head float parts exerted on a set of blade blocks to lift the set of blade blocks among the multiple blade blocks off the head case.

For a user to shave hair difficult to access or short hair, they may apply only one set of blade blocks to the target part intentionally. If the shaver is configured so that the head sinks earlier than the set of blade blocks with respect to the body, the head, which is a part different from the blade blocks intended by the user, preferentially moves, possibly causing the user to feel discomfort.

According to the aspect, the blade blocks sink according to undulations of skin with respect to the head case, which easily forms a state where the head does not substantially sink with respect to the body. This decreases chances of the user feeling discomfort. If the head is strongly pressed against the skin, the blade blocks sink with respect to the head case, and further the head sinks with respect to the body. Consequently, a force exerted on the skin is absorbed, which hardly irritates the skin strongly.

[5] With the electric shaver according to one aspect of the disclosure, a force of the head float part exerted on the head to lift the head off the body is smaller than a sum of forces that the multiple blade float parts exerted on the corresponding ones of the multiple blade blocks to lift the multiple blade blocks off the head case.

According to the aspect, when all the blade blocks are pressed against the skin, the head sinks earlier than the multiple blade blocks. Accordingly, even if the forces exerted on the multiple blade blocks are different from one another, the multiple blade blocks uniformly sink with respect to the head case. Consequently, when all the blade blocks are pressed against the skin, only part of the multiple blade blocks rarely contact the skin strongly.

[6] With the electric shaver according to one aspect of the disclosure, the swing supporting part has a pin that forms one of the two swing axes, and the head is supported by the pin so as to be swingable about the pin.

According to the aspect, the head supporting part can be formed smaller than the case where the two swing axes are formed of a 4-node link mechanism for example. Accordingly, the distance between the head and the body can be set shorter to enhance the operability of the electric shaver.

[7] The electric shaver according to one aspect of the disclosure further includes a drive source disposed inside the head and driving the inner blade, a power supply unit supplying power to the drive source, and a lead wire connecting the drive source with the power supply unit. The head supporting further includes a wiring path for linearly routing the lead wire.

According to the aspect, a bent part is not substantially formed in the part of the lead wire where passing through the head supporting part, and thus a current flows more efficiently than the case where a bent part is formed in the lead wire.

Exemplary Embodiment

FIG. 1 is a perspective view of the appearance of an electric shaver according to an embodiment. As shown in FIG. 1, electric shaver 1 includes body 10, head 20 for shaving hair, and head supporting part 50 connecting body 10 with head 20. Body 10 includes grip 11, power switch 12 for switching power between on and off, and power supply unit 13 (refer to FIG. 6) supplying power to drive source 22 (refer to FIG. 6).

Figure 2:
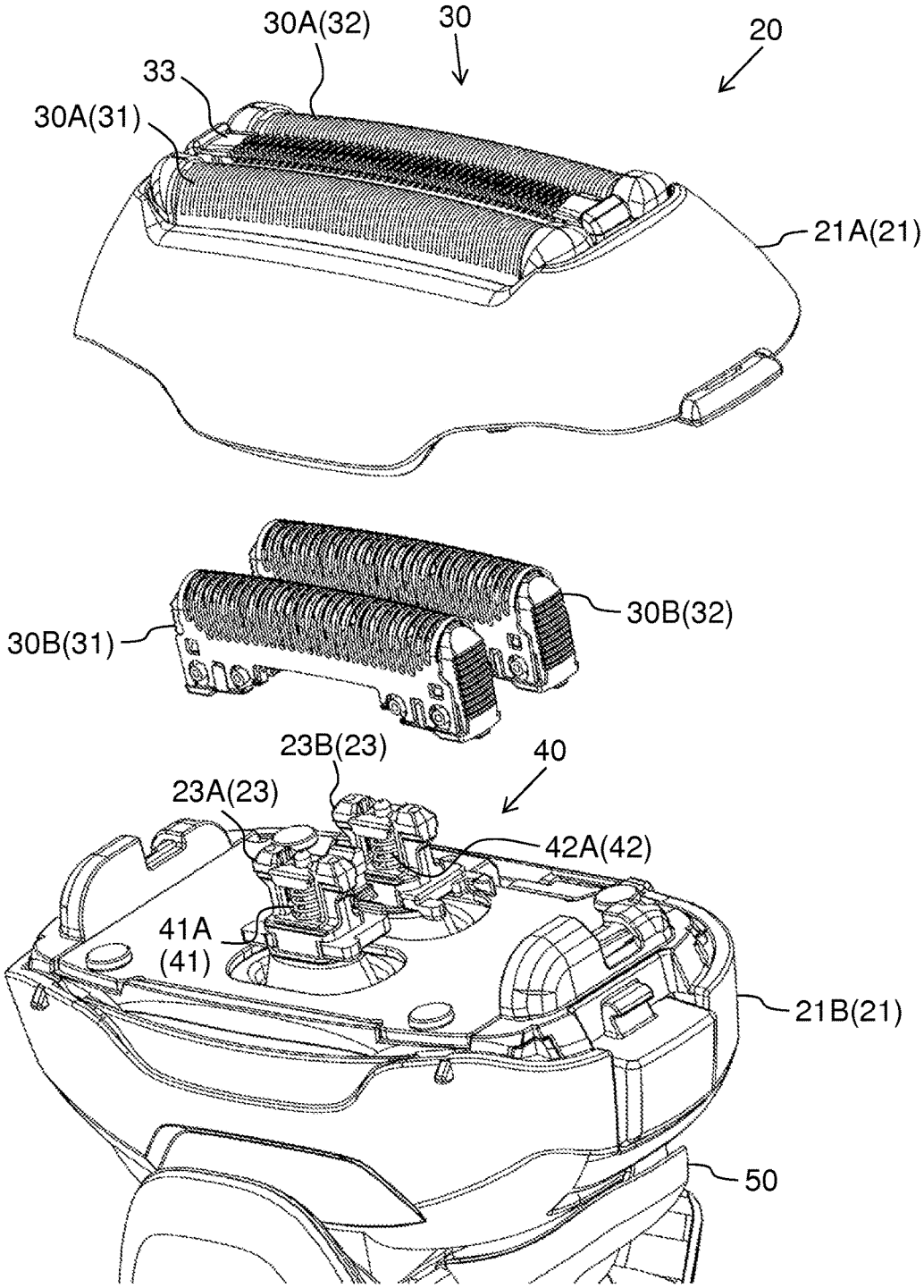
FIG. 2 is an exploded perspective view of a head according to the embodiment.

FIG. 2 illustrates the internal structure of head 20 according to the embodiment. Head 20 includes head case 21 forming the outer shell, multiple blade blocks 30, drive source 22 (refer to FIG. 6) driving multiple blade blocks 30, and multiple transmission mechanisms 23 connecting drive source 22 with multiple blade blocks 30.

Head case 21 includes top head case 21A in which multiple blade blocks 30 are provided, and bottom head case 21B containing drive source 22. Head case 21 is composed of top head case 21A and bottom head case 21B joined together.

Figure 3:
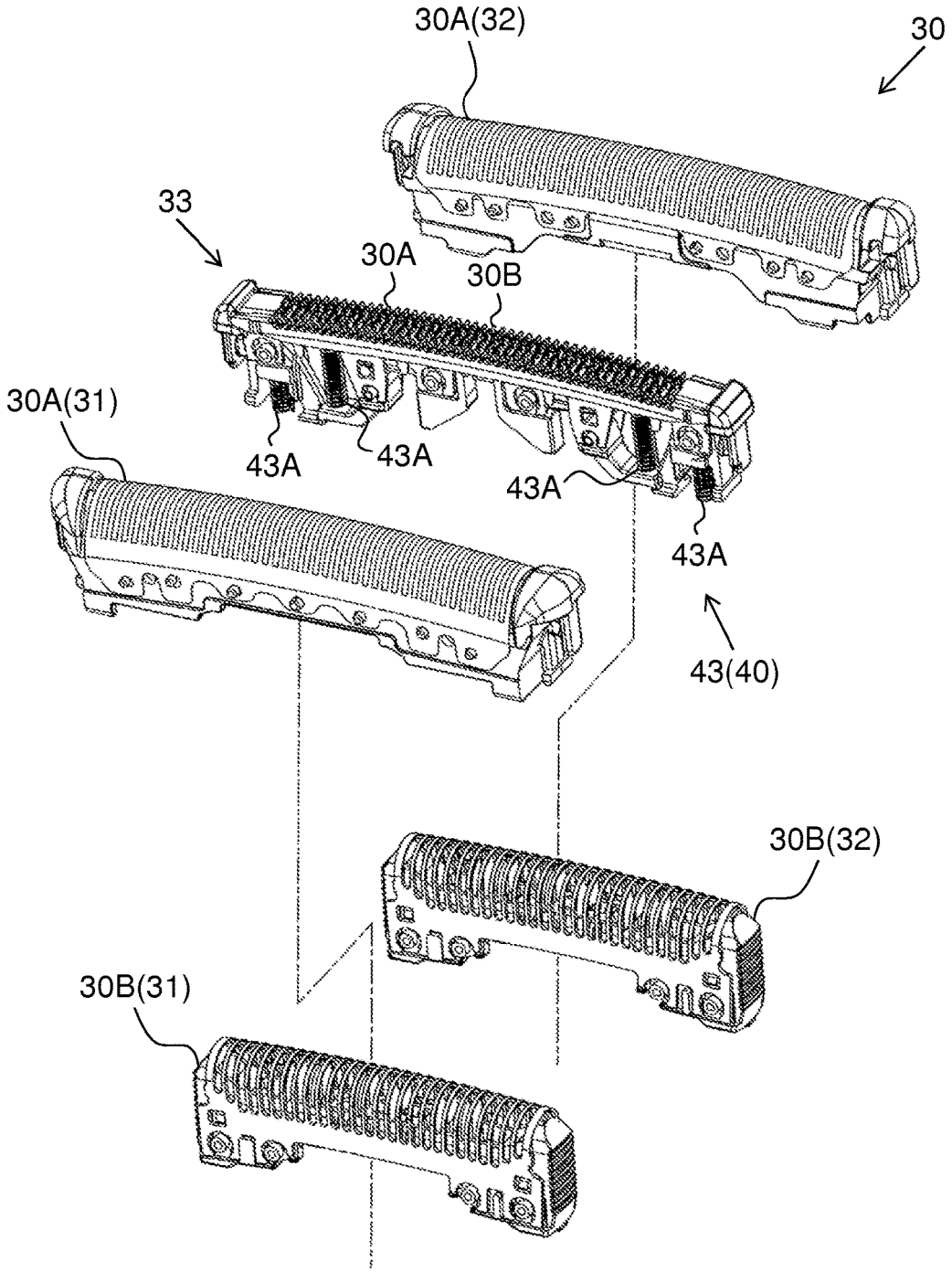
FIG. 3 is an exploded perspective view of blade blocks according to the embodiment.

FIG. 3 illustrates multiple blade blocks 30 according to the embodiment. In the embodiment, multiple blade blocks 30 include first blade block 31, second blade block 32, and third blade block 33. Each of these blade blocks is a set of outer blade 30A and inner blade 30B and is disposed in the transverse direction of head 20 (refer to FIG. 2).

Outer blade 30A is supported by top head case 21A movably up and down with respect to top head case 21A (refer to FIG. 2). Inner blade 30B is attached to transmission mechanism 23 (refer to FIG. 2).

First blade block 31 is disposed near the front of head 20. Second blade block 32 is disposed near the back of head 20. Third blade block 33 is disposed between first blade block 31 and second blade block 32. Outer blade 30A and inner blade 30B have an elongate shape. The longitudinal direction of first blade block 31 through third blade block 33, which is the longitudinal direction of outer blade 30A and inner blade 30B, runs along the longitudinal direction of head 20.

In this embodiment, drive source 22 is a linear motor and is provided with transmission mechanisms 23A and 23B that transmit reciprocating motion of the linear motor to first blade block 31 and second blade block 32, respectively, as shown in FIG. 2. Transmission mechanisms 23A and 23B project earlier than bottom head case 21B.

Transmission mechanism 23A has inner blade 30B of first blade block 31 and inner blade 30B of third blade block 33 each attached thereto. Transmission mechanism 23B has inner blade 30B of second blade block 32 each attached thereto.

Following a reciprocating motion of drive source 22, transmission mechanisms 23A and 23B move reciprocatingly in the longitudinal direction of head 20. The reciprocating motions of transmission mechanisms 23A and 23B have phases opposite to each other. In other words, inner blade 30B of first blade block 31 and inner blade 30B of third blade block 33 always move in the direction opposite to inner blade 30B of second blade block 32.

Head 20 further includes multiple blade float parts 40. Blade float parts 40 support first blade block 31 through third blade block 33 so that they are movable up and down with respect to top head case 21A. In the embodiment, multiple blade float parts 40 include first blade float part 41, second blade float part 42, and third blade float part 43 (refer to FIG. 3).

First blade float part 41, formed in transmission mechanism 23A, includes elastic material 41A provided to exert a reactive force that brings inner blade 30B of first blade block 31 close to outer blade 30A, on inner blade 30B. In the embodiment, elastic material 41A is a coil spring.

In detail, with a force pressing first blade block 31 toward body 10 (refer to FIG. 1) exerted on outer blade 30A, first blade block 31 moves toward body 10 with respect to top head case 21A while compressing elastic material 41A. With the pressing force exerted on outer blade 30A decreasing, first blade block 31 moves in the direction opposite to body 10 with respect to top head case 21A due to a reactive force of elastic material 41A.

Second blade float part 42, formed in transmission mechanism 23B, includes elastic material 42A provided to exert a reactive force that brings inner blade 30B of second blade block 32 close to outer blade 30A, on inner blade 30B. In the embodiment, elastic material 42A is a coil spring. Second blade block 32, when supported by second blade float part 42, acts in the same way as first blade block 31 with respect to top head case 21A.

As shown in FIG. 3, third blade float part 43, formed in third blade block 33, includes multiple elastic materials 43A provided to exert a reactive force on third blade block 33. In the embodiment, elastic material 43A is a coil spring. Third blade block 33, supported by third blade float part 43, acts in the same way as first blade block 31 with respect to top head case 21A. Elastic materials 41A, 42A, and 43A have the same elastic modulus for example.

Figure 4:
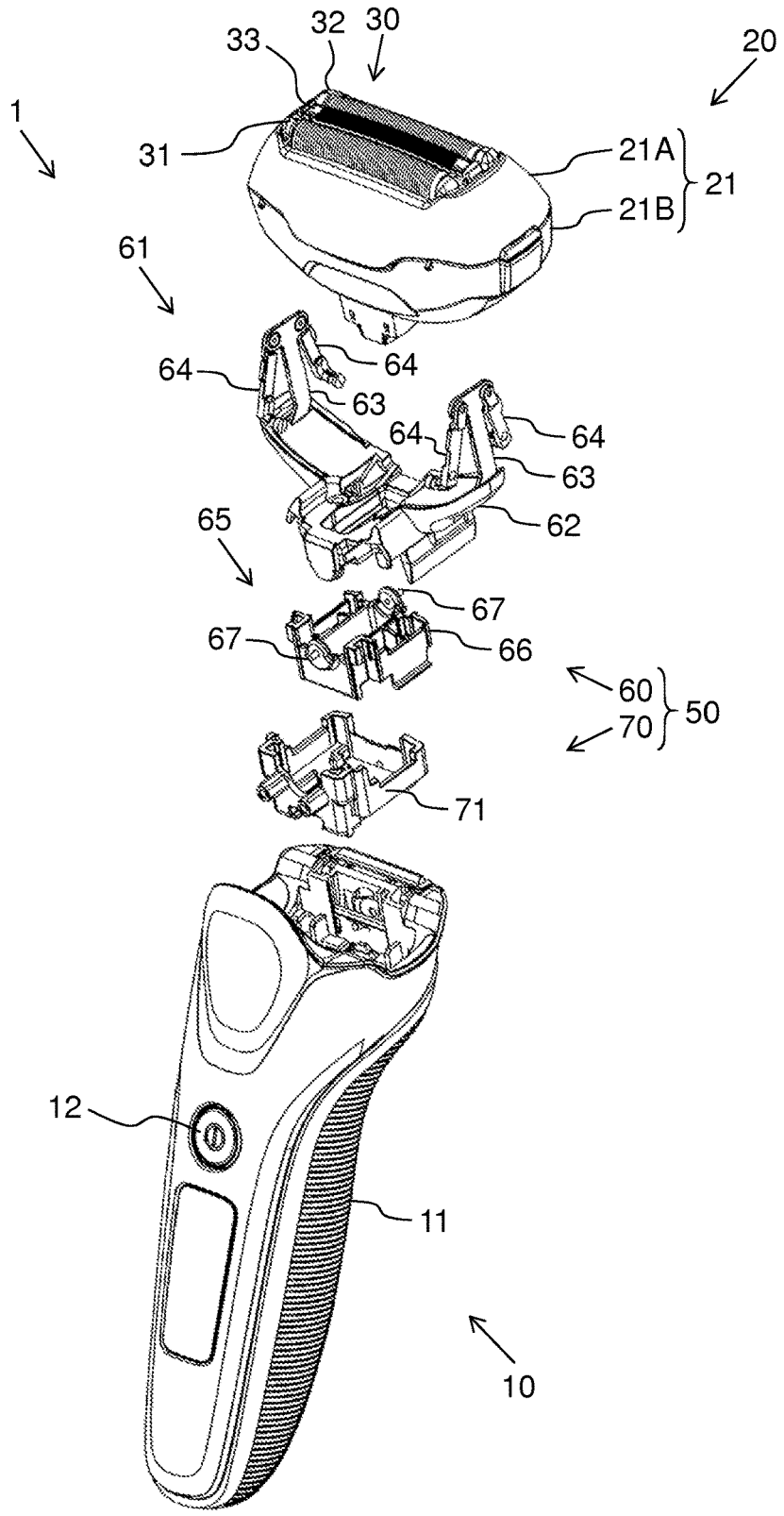
FIG. 4 is an exploded perspective view of the electric shaver according to the embodiment.

FIG. 4 is an exploded perspective view of the configuration of electric shaver 1. As shown in FIG. 4, head supporting part 50 includes swing supporting part 60 supporting head 20 so that head 20 is swingable about the two swing axes; and head float part 70 supporting head 20 so that head 20 is movable up and down with respect to body 10.

Swing supporting part 60 includes first supporting part 61 forming first swing axis XA (refer to FIG. 5) that is one of the two swing axes; and second supporting part 65 forming second swing axis XB (refer to FIG. 5) that is the other of the two swing axes. First swing axis XA is a swing axis extending in the longitudinal direction of head 20. Second swing axis XB is a swing axis extending in the transverse direction of head 20.

Head 20 is attached to first supporting part 61 so that head 20 is swingable about first swing axis XA with respect to first supporting part 61. Head 20, when swinging about first swing axis XA, swings lengthwise with respect to body 10.

First supporting part 61 is attached to second supporting part 65 so that first supporting part 61 is swingable about second swing axis XB with respect to second supporting part 65. First supporting part 61, when swinging about second swing axis XB, swings crosswise with respect to body 10.

As shown in FIG. 4, first supporting part 61 includes first supporting body 62 connected with second supporting part 65; and a pair of first support arms 63 attached to both longitudinal ends of first supporting body 62.

First supporting part 61 further includes two pairs of second support arms 64 each pair rotatably connected to the pair of first support arms 63. Head 20 is rotatably attached to four second support arms 64. First swing axis XA is a swing axis of 4-node link mechanism composed of first support arm 63 and second support arm 64.

Figure 5:
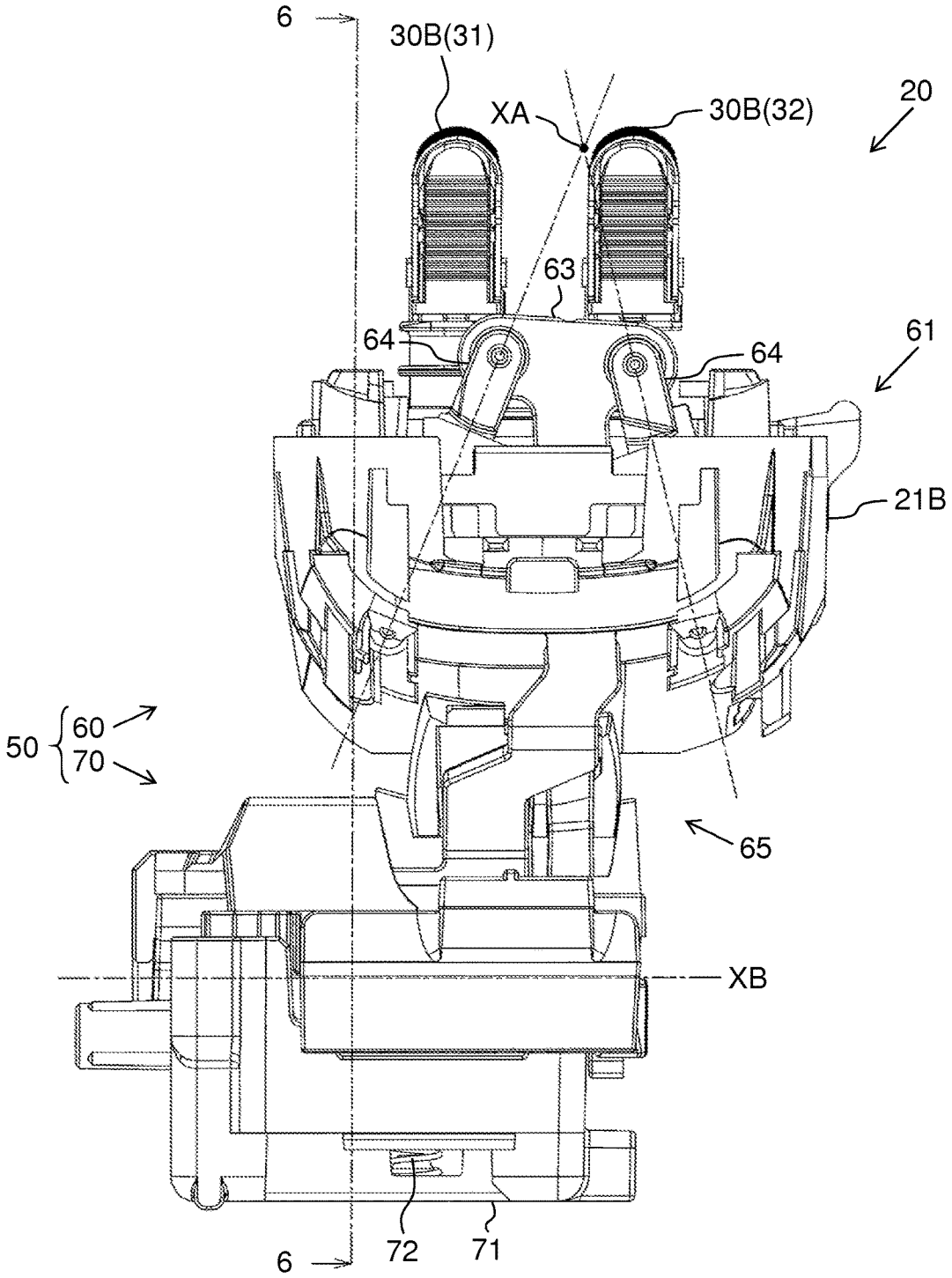
FIG. 5 is a side view of a head supporting part according to the embodiment.
Figure 6:
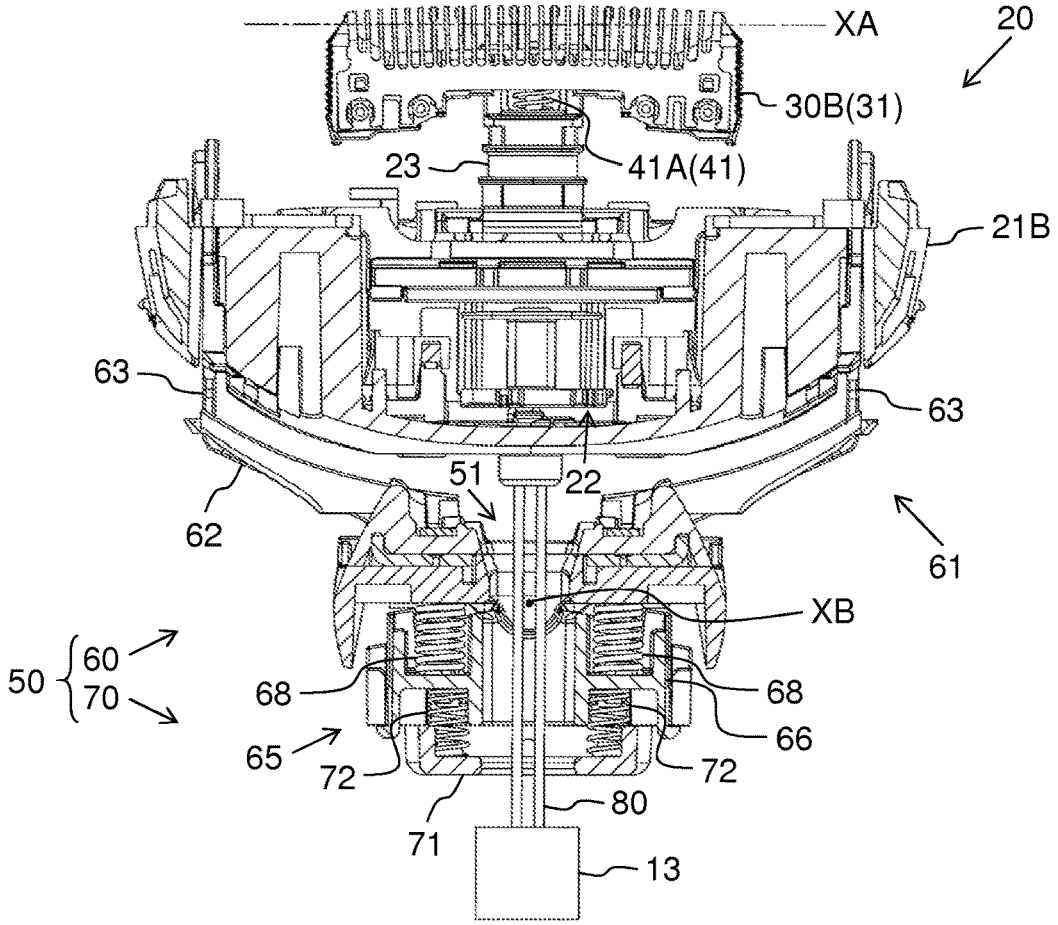
FIG. 6 is a sectional view taken along line 6-6 of FIG. 5.

FIG. 5 is a side view of head 20 with top head case 21A omitted. FIG. 6 is a sectional view of the internal structure of head 20 taken along line 6-6 of FIG. 5.

As shown in FIG. 5, the virtual lines (indicated with dashed-dotted lines) each extending in the longitudinal directions of the pair of second support arms 64 attached to one of first support arms 63 form an intersection point. The virtual lines each extending in the longitudinal directions of the pair of second support arms 64 attached to the other of first support arms 63 form an intersection point (not illustrated). First swing axis XA passes through these two intersection points.

With swing supporting part 60 shown in FIG. 5, first swing axis XA is formed closer to multiple blade blocks 30 than from head float part 70.

As shown in FIG. 4, second supporting part 65 includes second supporting body 66 joined with head float part 70, a pair of pins 67 projecting in the lengthwise directions of second supporting body 66, and a pair of springs 68 (refer to FIG. 6) assisting head 20 swinging about second swing axis XB. The pair of pins 67 forms second swing axis XB.

With swing supporting part 60 shown in FIG. 4, second swing axis XB is formed closer to multiple blade blocks 30 than from head float part 70.

First supporting body 62 is attached to the pair of pins 67 swingably with respect to second supporting body 66. First supporting body 62, when swinging about the pair of pin 67, swings about second swing axis XB.

As shown in FIG. 6, the pair of springs 68 is disposed between first supporting body 62 and second supporting body 66. One of springs 68 exerts a force encouraging first supporting body 62 to swing in one direction about second swing axis XB, on first supporting body 62. The other of springs 68 exerts a force encouraging first supporting body 62 to swing in the other direction about second swing axis XB, on first supporting body 62.

Head float part 70 includes case 71 joined with body 10 (refer to FIG. 4); and at least one elastic material 72 exerting a force on head 20 (refer to FIG. 4) to lift up head 20 off body 10. In this embodiment, elastic material 72 is formed of two coil springs.

Second supporting body 66 is supported by case 71 so as to be slidable up and down with respect to case 71. Each of elastic materials 72 is disposed between second supporting body 66 and case 71 and exerts a force pressing second supporting body 66 in the direction opposite to body 10, on second supporting body 66.

With a force pressing head 20 toward body 10 exerted on head 20, second supporting body 66 moves together with head 20 toward body 10 with respect to case 71 while compressing elastic material 72. With the pressing force exerted on head 20 decreasing, second supporting body 66 moves together with head 20 in the direction opposite to body 10 with respect to case 71.

The force of head float part 70, to lift up head 20 off body 10, exerting on head 20 is greater than the force of blade float part 40, to lift up blade block 30 off head case 21 (refer to FIG. 4), exerting on blade block 30. The force of head float part 70, to lift up head 20 off body 10, exerting on head 20 is smaller than the total force of each of multiple blade float parts 40, to lift up multiple blade blocks 30 off head case 21, exerting on corresponding blade block 30.

Figure 7:
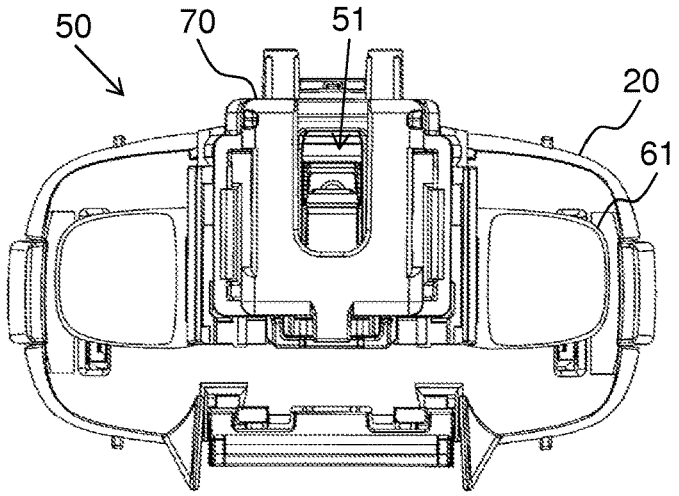
FIG. 7 is a bottom view of the head supporting part according to the embodiment.

As shown in FIGS. 6 and 7, electric shaver 1 (refer to FIG. 1) further includes lead wire 80 connecting drive source 22 with power supply unit 13. Power supply unit 13 includes a power source (e.g., a battery, illustration omitted) for drive source 22, a converter (illustration omitted) converting AC power to DC power, and a drive circuit (illustration omitted) for driving drive source 22.

Lead wire 80 connects drive source 22 with the drive circuit for power supply unit 13. Lead wire 80 is linearly routed through wiring path 51 formed in head supporting part 50. As shown in FIG. 7, the length of wiring path 51 in the transverse direction of head 20 is longer than that in the longitudinal direction of head 20.

Figure 8:
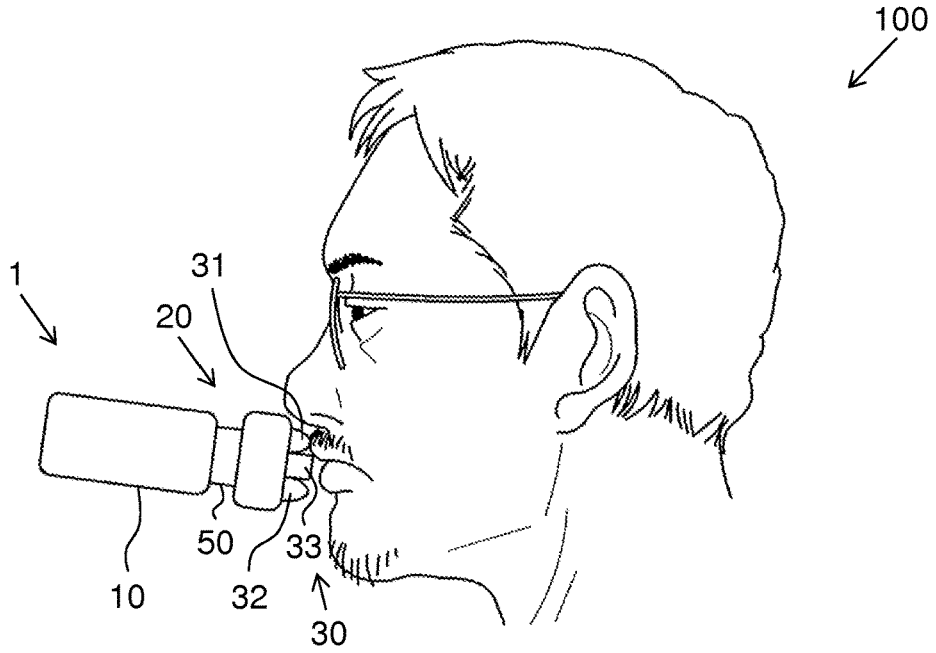
FIG. 8 is a side view of the electric shaver according to the embodiment, in a state being used.
Figure 9:
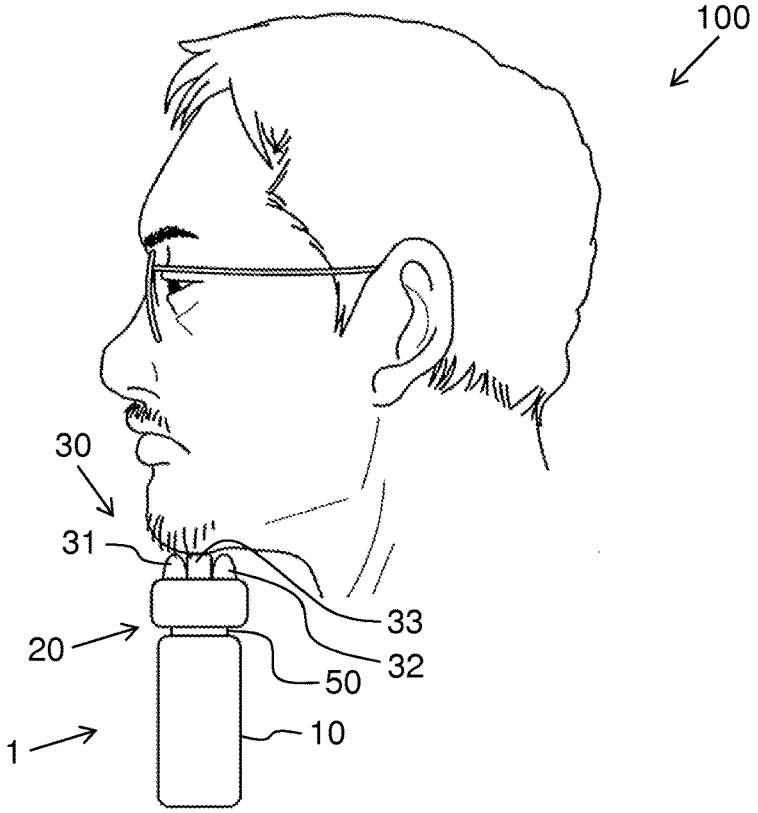
FIG. 9 is a side view of the electric shaver according to the embodiment, in a state being used.

A description is made of the effects of electric shaver 1 in reference to FIGS. 8 and 9.

When the power is turned on by operation of power switch 12 (refer to FIG. 1), drive source 22 (refer to FIG. 6) is activated. Inner blades 30B (refer to FIG. 2) of multiple blade blocks 30 are driven by drive source 22 and reciprocatingly move with respect to outer blades 30A (refer to FIG. 2).

When head 20 is moved while being pressed against the skin in this state, multiple blade blocks 30 performs shaving. At this moment, head 20 swings about at least one of first swing axis XA and second swing axis XB according to undulations of the skin. Resultingly, head 20 moves on the skin while changing the angle with respect to body 10 following undulations of the skin.

As shown in FIG. 8, for user 100 to shave hair difficult to access (e.g., a mustache), they intentionally applies outer blade 30A (i.e., one of multiple blade blocks 30, refer to FIG. 2) of first blade block 31 or second blade block 32, onto beneath the nose.

At this moment, when head 20 is strongly pressed against the skin, first blade block 31 or second blade block 32 sinks earlier than head case 21. If head 20 is more strongly pressed against the skin, head 20 sinks with respect to body 10.

As shown in FIG. 9, for user 100 to shave hair easy to access (e.g., a beard), they applies outer blades 30A of all blade blocks 30, to the chin. At this moment, if head 20 is strongly pressed against the skin, head 20 sinks earlier than body 10. If head 20 is more strongly pressed against the skin, all blade blocks 30 sink with respect to head case 21.

Electric shaver 1 according to the aspect provides the following advantages for example.

(1) Head 20 is swingable about first swing axis XA and second swing axis XB. Accordingly, the angle of head 20 with respect to body 10 easily changes following the shape of skin. Head 20 is movable up and down with respect to body 10, and thus if strongly pressed against the skin, head 20 sinks with respect to body 10 to reduce a force exerted on the skin. Consequently, the skin hardly enters the inside of outer blade 30A, which hardly irritates the skin strongly.

(2) A shorter distance between outer blade 30A (i.e., a part where head 20 contacts the skin) and first swing axis XA and second swing axis XB provides a smaller amount of movement of head 20 while head 20 is swinging following undulations of the skin, which enhances the operability of electric shaver 1.

With electric shaver 1 according to the embodiment, first swing axis XA and second swing axis XB are formed closer to multiple blade blocks 30 than from head float part 70.

Accordingly, compared to the case where head float part 70 is disposed closer to blade block 30 than from at least one of first swing axis XA and second swing axis XB, the distance between the part where head 20 contacts the skin and first swing axis XA and second swing axis XB is shorter, which enhances the operability of electric shaver 1.

(3) For user 100 to shave hair difficult to access or short hair, they may apply only first blade block 31, for example, of multiple blade blocks 30 to the target part intentionally. In the case where head 20 sinks earlier than first blade block 31 with respect to body 10, head 20, which is different from first blade block 31 as a target intended by user 100, preferentially moves, possibly causing user 100 to feel discomfort.

With electric shaver 1 according to the embodiment, the force of blade float part 40 exerting on blade block 30 to lift up blade block 30 off head case 21 is smaller than the force of head float part 70 exerting on head 20 to lift up head 20 off body 10.

According to the embodiment, blade block 30 sinks according to undulations of skin with respect to head case 21, which easily forms a state where head 20 does not substantially sink with respect to body 10. This decreases chances of user 100 feeling discomfort.

If head 20 is strongly pressed against the skin, blade block 30 sinks with respect to head case 21, and further head 20 sinks with respect to body 10. Consequently, a force exerted on the skin is absorbed, which hardly irritates the skin strongly.

(4) If all blade blocks 30 are pressed against the skin, head 20 sinks earlier than multiple blade blocks 30. Accordingly, even if the forces exerted on multiple blade blocks 30 are different from one another, multiple blade blocks 30 uniformly sink with respect to head case 21. Consequently, when all blade blocks 30 are pressed against the skin, only part of multiple blade blocks 30 rarely contact the skin strongly.

(5) When first supporting body 62 swings about a pair of pins 67 forming second swing axis XB, head 20 swings in the right and left directions with respect to body 10. Accordingly, head supporting part 50 can be formed smaller than the case where second swing axis XB is formed of a 4-node link mechanism for example. Consequently, the distance between head 20 and body 10 can be set shorter to enhance the operability of electric shaver 1.

(6) Lead wire 80 is linearly routed through wiring path 51 formed in head supporting part 50. Accordingly, a bent part is not substantially formed in the part of lead wire 80 where passing through head supporting part 50. Consequently, a current flows more efficiently than the case where a bent part is formed in lead wire 80.

(7) The length of wiring path 51 in the transverse direction of head 20 is longer than that in the longitudinal direction of head 20. Accordingly, even if head 20 swings about first swing axis XA, lead wire 80 becomes resistant to strongly contacting the inner surface of wiring path 51, which prevents deterioration of lead wire 80.

Modified Example

The description related to the exemplary embodiment exemplifies a possible form of an electric shaver according to the disclosure and is not intended to limit the form. An electric shaver according to the disclosure can take a form of the following modified examples or a form produced from a combination of at least two modified examples compatible with each other.

- The shape of wiring path 51 may be freely selected. As one example, wiring path 51 may have a bent shape.
- The number of pins 67 of second supporting part 65 may be freely selected. As one example, second supporting part 65 may have one or at least three pins 67.
- The structure of forming second swing axis XB may be freely selected. As one example, second swing axis XB may be formed of a 4-node link mechanism, where two pins 67 are omitted in second supporting part 65.
- The relationship between a force of head float part 70 exerting on head 20 and that of blade float part 40 exerting on all blade blocks 30 may be freely selected. As one example, a force of head float part 70 exerting on head 20 may be greater than or equal to that of blade float part 40 exerting on all blade blocks 30.
- The relationship between a force of head float part 70 exerting on head 20 and that of blade float part 40 exerting on blade block 30 may be freely selected. As one example, a force of head float part 70 exerting on head 20 may be smaller than or equal to that of blade float part 40 exerting on blade block 30.
- The position of head float part 70 may be freely selected. As one example, head float part 70 may be disposed closer to blade block 30 than from at least one of first swing axis XA and second swing axis XB.
- The material used for elastic materials 41A, 42A, 43A, and 72 may be freely selected. As one example, elastic materials 41A, 42A, 43A, and 72 may be made of a leaf spring or a disk spring.
- The relationship between the elastic moduli of elastic materials 41A, 42A, and 43A may be freely selected.

As one example, at least one of elastic materials 41A, 42A, and 43A may have an elastic modulus different from the others.

The number of blade blocks 30 of head 20 may be freely selected. As one example, one or two of three blade blocks 30 may be omitted. As another example, four or more blade blocks 30 may be omitted.

Electric shaver 1 includes, instead of outer blade 30A and inner blade 30B both having an elongate shape, an outer blade and an inner blade having a circle or its similar shape. With this configuration, the inner blade rotates with respect to the outer blade to shave hair.

The above-described embodiments are applicable to a hair remover and a depilator for example, besides an electric shaver.

The invention claimed is:

1. An electric shaver comprising:

a body having a grip;

a head including a plurality of blade blocks, each of which includes a set of an outer blade and an inner blade;

a head supporting part connecting the body with the head, a head case supporting the outer blade of each of the plurality of blade blocks; and a plurality of blade float parts supporting the plurality of blade blocks so that the plurality of blade blocks are vertically movable with respect to the head case, wherein:

the head supporting part includes:

a swing supporting part supporting the head swingably about two swing axes crossing with each other; and a head float part supporting the head so that the head is vertically movable with respect to the body, the swing supporting part includes:

a first supporting part forming a first swing axis of the two swing axes; and a second supporting part forming a second swing axis of the two swing axes, the second supporting part includes a pin forming the second swing axis, the head is supported by the pin so that the head is swingable about the pin, and a force of the head float part exerted on the head to lift the head off the body is greater than a force of the plurality of blade float parts exerted on one of the plurality of blade blocks to lift the one of the plurality of blade blocks off the head case.

2. The electric shaver of claim 1, wherein the force of the head float part exerted on the head to lift the head off the body is smaller than a sum of forces that the plurality of blade float parts exert on the corresponding ones of the plurality of blade blocks to lift the plurality of blade blocks off the head case.

3. An electric shaver comprising:

a body having a grip;

a head having a blade block that is a set of an outer blade and an inner blade; and a head supporting part connecting the body with the head, wherein the head supporting part includes:

a swing supporting part supporting the head swingably about two swing axes crossing with each other; and a head float part supporting the head so that the head is vertically movable with respect to the body, the swing supporting part includes:

a first supporting part forming, as a first swing axis, one of the two swing axes; and a second supporting part forming, as a second swing axis, the other of the two swing axes, the first supporting part is attached to the second supporting part so that the first supporting part is swingable about the second swing axis with respect to the second supporting part, the second supporting part includes a pin forming the other of the two swing axes, and the head is supported by the pin so that the head is swingable about the pin.

4. The electric shaver of claim 3, wherein at least one of the two swing axes is disposed closer to the blade block than the head float part.

5. The electric shaver of claim 4, wherein the other of the two swing axes is disposed between the blade block and the head float part.

6. The electric shaver of claim 3, further comprising:

a drive source disposed inside the head and driving the inner blade;

a power supply unit supplying power to the drive source; and a lead wire connecting the drive source with the power supply unit, wherein the head supporting part further includes a wiring path for linearly routing the lead wire.

7. An electric shaver comprising:

a body having a grip;

a head having a blade block that is a set of an outer blade and an inner blade; and a head supporting part connecting the body with the head, wherein:

the head supporting part includes:

a swing supporting part supporting the head swingably about two swing axes crossing with each other; and a head float part supporting the head so that the head is vertically movable with respect to the body, the swing supporting part includes:

a first supporting part forming one of the two swing axes; and a second supporting part forming the other of the two swing axes, the first supporting part includes a first supporting body connected with the second supporting part, a pair of first support arms and two pairs of second support arms, wherein each of the two pairs of second support arms is connected to a corresponding one of the first support arms, the head is rotatably attached to the two pairs of second support arms, the second supporting part includes a pin forming the other of the two swing axes, and the head is supported by the pin so that the head is swingable about the pin.

8. The electric shaver of claim 7, wherein at least one of the two swing axes is disposed closer to the blade block than the head float part.

9. The electric shaver of claim 8, wherein the other of the two swing axes is disposed between the blade block and the head float part.

10. The electric shaver of claim 7, further comprising:

a drive source disposed inside the head and driving the inner blade;

a power supply unit supplying power to the drive source; and a lead wire connecting the drive source with the power supply unit, wherein the head supporting part further includes a wiring path for linearly routing the lead wire.

* * * * *